US005513688A

United States Patent [19]

Morita et al.

[11] Patent Number: 5,513,688

[45] Date of Patent: May 7, 1996

[54] METHOD FOR THE PRODUCTION OF DISPERSION STRENGTHENED METAL MATRIX COMPOSITES

[75] Inventors: Yusuke Morita; Kazuhiro Ozawa; Akihiko Nanba, all of Chiba, Japan

[73] Assignee: Rheo-Technology, Ltd., Japan

[21] Appl. No.: 124,933

[22] Filed: Sep. 21, 1993

[30] Foreign Application Priority Data

| | | | |
|---|---|---|---|
| Dec. 7, 1992 | [JP] | Japan | 4-351071 |
| Mar. 16, 1993 | [JP] | Japan | 5-055844 |
| Jun. 22, 1993 | [JP] | Japan | 5-173588 |
| Jun. 22, 1993 | [JP] | Japan | 5-173589 |

[51] Int. Cl.[6] ..... B22D 27/08

[52] U.S. Cl. ..... 164/71.1; 164/900

[58] Field of Search ..... 164/900, 97, 98, 164/66.1, 71.1; 428/614; 420/590

[56] References Cited

U.S. PATENT DOCUMENTS

| | | | |
|---|---|---|---|
| 3,951,651 | 4/1976 | Mehrabian et al. | 420/590 |
| 4,089,680 | 5/1978 | Flemings | 164/71.1 |
| 4,759,995 | 7/1988 | Skibo et al. | 164/97 |
| 4,786,467 | 11/1988 | Skibo et al. | 420/590 |
| 4,865,806 | 9/1989 | Skibo et al. | 420/590 |
| 4,865,808 | 9/1989 | Ichikawa et al. | 428/614 |

FOREIGN PATENT DOCUMENTS

| | | |
|---|---|---|
| 0104682 | 4/1984 | European Pat. Off. . |
| 54-33807 | 3/1979 | Japan . |
| 57-82441 | 5/1982 | Japan . |
| 60-77946 | 5/1985 | Japan . |
| 61-104039 | 5/1986 | Japan . |
| 63-176442 | 7/1988 | Japan . |
| 1-96341 | 4/1989 | Japan . |
| 1-247539 | 10/1989 | Japan . |
| 2-166242 | 2/1990 | Japan . |
| 2-166241 | 6/1990 | Japan . |
| WO87/06624 | 11/1987 | WIPO . |
| WO92/01821 | 2/1992 | WIPO . |

OTHER PUBLICATIONS

"Die Casting Partially Solidified High Copper Content Alloys", E. F. Fascettta, et al. 1973 Metals Research Journal, p. 167.

*Primary Examiner*—Samuel M. Heinrich
*Assistant Examiner*—James Miner
*Attorney, Agent, or Firm*—Austin R. Miller

[57] ABSTRACT

Dispersion strengthened metal matrix composites are produced by stirring a mixed solid-liquid phase slurry as a dispersing medium under a reduced pressure, adding a dispersion strengthening material to the dispersing medium, and continuing the stirring under the reduced pressure till the dispersion strengthening material is uniformly dispersed in the dispersing medium.

8 Claims, 9 Drawing Sheets

1
2
3
4
5
6
7
8

100μm

METHOD FOR THE PRODUCTION OF DISPERSION STRENGTHENED METAL MATRIX COMPOSITES

BACKGROUND OF THE INVENTION

1. Field of the Invention

This invention relates to a method for the production of dispersion strengthened metal matrix composites (hereinafter referred to as a composite material) in which a dispersion strengthening material such as metal, metallic compound, ceramic particle, whisker or the like is uniformly dispersed in a metal dispersing medium (metal matrix).

2. Description of the Related Art

Recently, composite materials attempting the improvement of properties such as strength of parts and the like have been noticed and gradually put into practical use.

In the production of these composite materials, it is important to know how to uniformly disperse the dispersion strengthening material into the metal dispersing medium for obtaining good quality in addition that they are cheap.

As the conventional method for the production of the composite material, there are known several processes as mentioned below.

High pressure casting process: A molten alloy as a dispersing medium is impregnated into a preform of a dispersion strengthening material under pressure and then solidified to form a composite material.

Powder working process: An alloy as a dispersing medium is pulverized and mixed with a dispersion strengthening material, which is extruded at a high temperature under pressure to form a composite material.

Mechanical alloying process: An alloy as a dispersing medium is pulverized and mixed with a dispersion strengthening material, which is mechanically kneaded to form a composite material.

Molten metal process: A dispersion strengthening material is added to a molten alloy as a dispersing medium and then mixed with stirring to form a composite material.

Semi-solidification process (inclusive of semimelting process): An alloy as a dispersing medium is rendered into a mixed solid-liquid phase slurry and added with a dispersion strengthening material, which is mixed with stirring to form a composite material.

Among these processes, the high pressure casting process using the preform of the dispersion strengthening material, the powder working process using the alloy powder and the mechanical alloying process are unfavorable because the production step is complicated and requires a great number of steps. Furthermore, these processes are difficult to produce large size composite materials.

On the other hand, the molten metal process and the semi-solidification process have merits that the production step is simple and large size composite materials can easily be produced. In the molten metal process, however, it is difficult to uniformly disperse the dispersion strengthening material into the dispersing medium and, hence, the composite material having excellent properties can not be obtained.

The semi-solidification process can easily attain the uniform dispersion of the dispersion strengthening material or the good formation of the composite material, but have the following problems. That is, when the dispersion strengthening material is added to the mixed solid-liquid phase slurry as a dispersing medium, if the wettability of the dispersion strengthening material to the slurry is insufficient, there is caused a problem that the dispersing medium reacts at its surface with the dispersion strengthening material to produce gas (frequently hydrogen gas), but the resulting reaction gas hardly floats up because the viscosity of the mixed solid-liquid phase slurry is high and, hence, it remains in the composite material to cause defects due to the entrapment of the gas or the like. Particularly, as the dispersion strengthening material becomes finer, the surface area increases (which is in inverse proportion to the particle size of the dispersion strengthening material) or the wetting area over the full surface of the dispersion strengthening material to the dispersing medium increases, but this material is apt to be rendered into a lump. When such a dispersion strengthening material is added to the mixed solid-liquid phase slurry, the insufficient wetting defect is caused in the composite material. Furthermore, the surface deposit increases with the increase of the surface area of the dispersion strengthening material and hence the amount of reaction gas produced increases, while atmosphere gas is entrapped into the slurry in the addition of the dispersion strengthening material as a lump. Since the viscosity of a composite slurry consisting of the mixed solid-liquid phase slurry and the dispersion strengthening material considerably increases as the dispersion strengthening material becomes finer, these gases hardly float up and hence the defects due to the entrapment of the gas are apt to be caused. As a result, there is caused a problem that the defect due to insufficient wetting and the defect due to entrapment of the gas increase and the good composite material can not be obtained. Moreover, when the alloy as a dispersing medium has a narrow temperature width between solidus line and liquidus line, and when the ratio of eutectic texture is large, the production of the composite material becomes difficult.

SUMMARY OF THE INVENTION

Under the above circumstances, it is an object of the invention to provide a method of producing composite materials having good properties through the semi-solidification process without causing defects due to the entrapment of the gas and the like at the uniform dispersed state of the dispersion strengthening material and even when using ultra-fine dispersion strengthening material.

It is another object of the invention to provide a method of producing composite materials uniformly dispersing the dispersion strengthening material and having excellent properties even when the temperature width between solidus line and liquidus line in the alloy as a dispersing medium in the composite material to be produced is very narrow and when the ratio of eutectic texture is large.

According to a first aspect of the invention, there is the provision of a method of producing a dispersion strengthened metal matrix composite, which comprises stirring a mixed solid-liquid phase slurry as a dispersing medium under a reduced pressure, adding a dispersion strengthening material to the dispersing medium, and continuing the stirring under the reduced pressure till the dispersion strengthening material is uniformly dispersed in the dispersing medium.

In a preferable embodiment of the invention, the resulting composite slurry consisting of the dispersing medium and the dispersion strengthening material is subjected to an overheat melting treatment in which the temperature is raised to a temperature higher than a liquids line of a metal in the dispersing medium to conduct degassing with the stirring under a reduced pressure after the addition of the dispersion strengthening material or the uniform dispersion thereof. In another preferable embodiment, an atmosphere under a reduced pressure is an inert gas and the reduced pressure is within a range of 100 Torr to $1\times10^{-4}$ Torr. Particularly, the reduced pressure is within a range of 1 Torr to $1\times10^{-4}$ Torr when using the ultra-fine dispersion strengthening material.

The ultra-fine dispersion strengthening material includes SiC particles having a particle size of not more than 1 μm and the like.

According to a second aspect of the invention, there is the provision of a method of producing dispersion strengthened metal matrix composites, which comprises preparing a mixed solid-liquid phase slurry of semi-solidified or semi-molten dispersing medium having such a composition that a temperature width between solidus line and liquidus line is wider than that of an alloy composition in a final product and a ratio of eutectic texture is small, incorporating a dispersion strengthening material into the slurry with stirring to form a precomposite material, adding an ingredient separately prepared for the compensation of the final alloy composition to the resulting molten precomposite material or adding the precomposite material to the molten ingredient with stirring.

In a preferable embodiment of the invention, when the final product is Al alloy, the temperature of the dispersing medium at the time of adding the compensational ingredient is within a range of from a liquidus line temperature of the final alloy composition to 150° C. higher than the liquidus line temperature and the addition with stirring is conducted in an inert gas atmosphere under a reduced pressure of 100 Torr to $1\times10^{-4}$ Torr. Furthermore, when the dispersing medium is a pure metal or an extreme-low alloy thereof such as pure copper or an extreme-low copper alloy, the final product is a high-strength and high-conductivity composite material.

DESCRIPTION OF THE PREFERRED EMBODIMENTS

Figure 1:
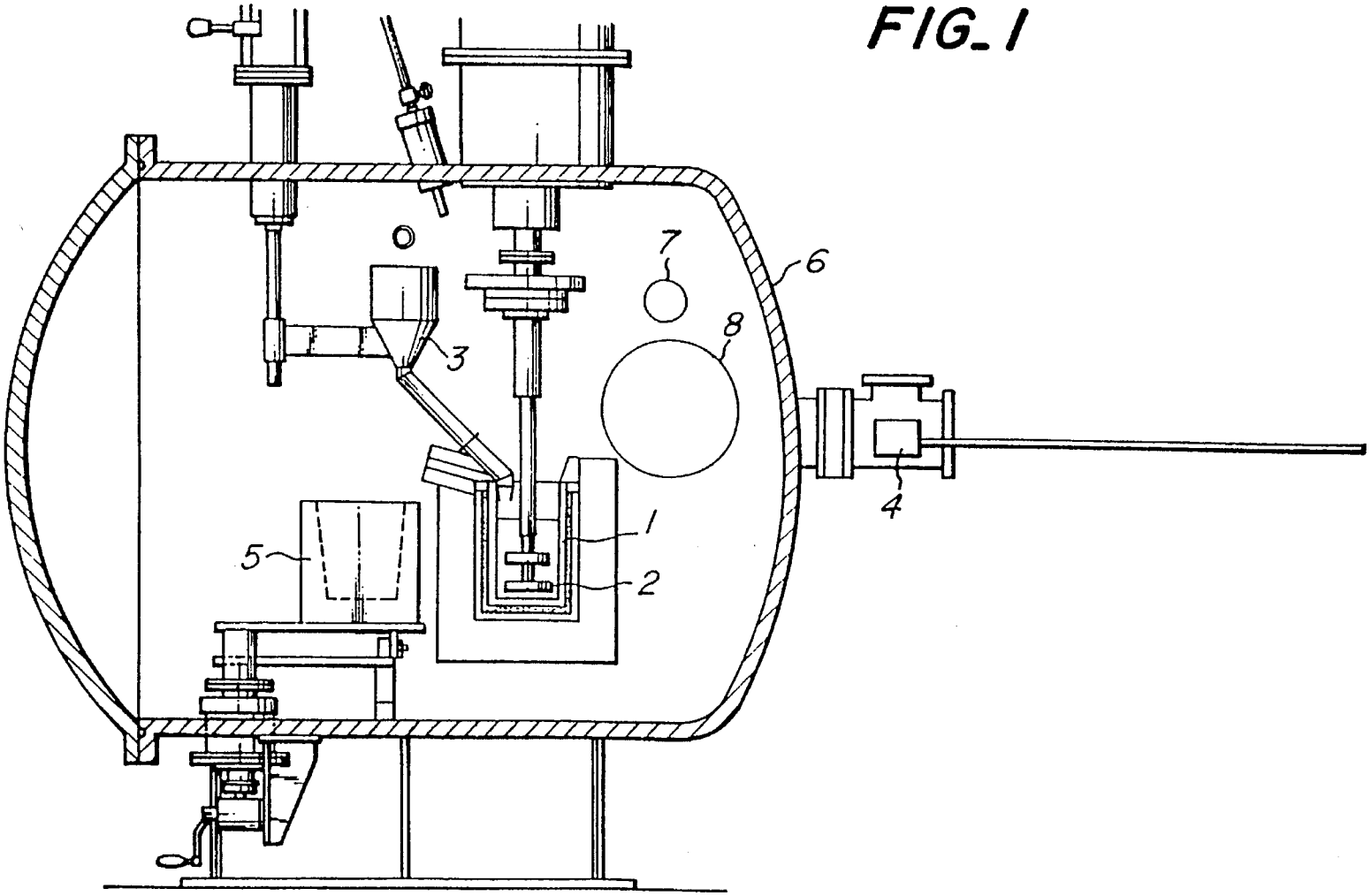
FIG. 1 is a diagrammatical view of an apparatus for the production of composite materials used in the invention.

In case of producing the composite material through the semi-solidification process, the feature that it is difficult to produce the composite materials having good properties as the dispersion strengthening material becomes finer is due to the following reasons. That is, as the dispersion strengthening material becomes finer, it is apt to form a lump and if such a lump is added to a mixed solid-liquid phase slurry, the amount of reaction gas produced in the slurry increases and also atmosphere gas is entrapped in the slurry. Furthermore, as the dispersion strengthening material becomes finer, the total surface area increases and also the wetting area and amount of surface deposit increase, so that when such a dispersion strengthening material is added to the mixed solid-liquid phase slurry as a dispersing medium, work done for wetting the full surface of the dispersion strengthening material and the amount of reaction gas between the dispersing medium and the surface deposit in the dispersion strengthening material become larger. Since the viscosities of the mixed solid-liquid phase slurry and the composite slurry after the addition of the dispersion strengthening material are high, the reaction gas produced in the slurry hardly floats up to the surface of the slurry.

On the contrary, the inventors have made various studies and experiments and established a method of producing composite materials having good properties without defects by uniformly dispersing the dispersion strengthening material through the semi-solidification process even if the dispersion strengthening material is fine or ultra-fine.

According to the first aspect of the invention, the dispersion strengthening material is first added to the mixed solid-liquid phase slurry as a dispersing medium with stirring under a reduced pressure. In this case, the dispersing medium is hardly oxidized due to holding of the reduced pressure, and even if the dispersion strengthening material is added to the dispersing medium in lump form, the atmosphere gas is less in the area surrounding the dispersion strengthening material and in the lump thereof, so that the reaction between the dispersing medium and the surface deposit to the dispersion strengthening material is accelerated to promote wetting of the dispersion strengthening material to the dispersing medium. Furthermore, since the viscosity of the slurry is high, the shearing force between the outer circumference of the lump of the dispersion strengthening material and the slurry under stirring becomes large and also the lump collides with a solid phase of metal in the dispersing medium to promote the wetting of the dispersion strengthening material from its lump surface, so that the circumference of the lump is gradually wetted to assist separation of the dispersion strengthening material from the lump and, hence, promote uniform dispersion of the dispersion strengthening material. However, as the dispersion strengthening material becomes finer, it becomes difficult to completely separate the lump of the dispersion strengthening material.

Even after the completion of the addition of the dispersion strengthening material to the dispersing medium, the stirring of the resulting composite slurry is continued under a reduced pressure till the dispersion strengthening material is uniformly dispersed in the dispersing medium. By the continuation of the stirring, the collision of the lump of the dispersion strengthening material with the solid phase (primary crystal grains) of metal as a dispersing medium is caused to separate the dispersion strengthening material from the lump due to the high viscosity of the composite slurry, whereby the uniform dispersion of the dispersion strengthening material can be promoted and further degassing can be accelerated with stirring under a reduced pressure.

Moreover, since the viscosity of the composite slurry is preferably higher, it is desirable that the fraction solid of the dispersing medium is large.

According to the invention, in order to attain the uniform dispersion of the dispersion strengthening material, it is preferable that the viscosity of the composite slurry after the addition of the dispersion strengthening material be larger, so that it is desirable that the amount of the dispersion strengthening material added is not less than 3% by volume.

Further, when the dispersion strengthening material is added to the mixed solid-liquid phase slurry with stirring under a reduced pressure, the generation of reaction gas between the surface portion of the slurry and the surface deposit in the dispersion strengthening material is promoted in the slurry to increase the ratio of the reaction gas generated on the surface portion of the slurry, and consequently the amount of reaction gas produced in the composite slurry is decreased to reduce the defect of the composite material due to the entrapment of the gas and also the surface deposit prematurely disappears to make the wetting of the dispersion strengthening material good and obtain a composite material having no defects.

Moreover, in the case of adding the dispersion strengthening material to the mixed solid-liquid phase slurry under a reduced pressure, even if the dispersion strengthening material is in lump form, the amount of atmospheric gas supplied from the dispersion strengthening material to the slurry is decreased under the reduced pressure. And also, the gas pressure in the lump is low and the gas pressure of the atmosphere around the dispersion strengthening material (lump) newly exposed after the wetted dispersion of the dispersion strengthening material is low, so that the dispersion strengthening material is easily contacted with the dispersing medium and, hence, the reaction gas is apt to be easily generated in the slurry to prematurely complete the generation of the reaction gas.

The discharge of the reaction gas from the composite slurry to the atmosphere under the reduced pressure becomes easy, so that the surface deposit rapidly disappears and the generation of the reaction gas prematurely completes.

The rapid completion of the generation of the reaction gas has an effect that when the operation time is constant, the degassing time in the composite slurry after the completion of the reaction gas generation can be ensured longer to conduct much degassing.

However, as the dispersion strengthening material becomes finer, the surface area of the dispersion strengthening material and the amount of surface deposit thereto increase and the lump is apt to be formed and also the amount of the lump added to the mixed solid-liquid phase slurry increases and the reaction between the dispersing medium in the surface portion of the slurry and the surface deposit inversely reduces to increase the generation of reaction gas in the mixed solid-liquid phase slurry and the amount of atmosphere gas entrapped in the slurry.

In the composite slurry formed by the addition of the dispersion strengthening material to the mixed solid-liquid phase slurry, the viscosity becomes higher as the dispersion strengthening material becomes finer and hence the floating speed of the gas becomes slower, so that the insufficient degassing is caused.

To this end, the composite slurry is subjected to an overheat melting treatment in which the temperature is raised to a temperature higher than a liquidus line temperature of metal as a dispersing medium to conduct the degassing with stirring under a reduced pressure. In this case, the temperature is raised to 150° C. higher than the liquidus line temperature of the metal.

In the overheat melting treatment, it is necessary that the stirring is continued for the uniform dispersion of the dispersion strengthening material and the degassing. Moreover, it is required to hold the composite slurry under a reduced pressure for conducting the degassing.

In the composite slurry, when the viscosity is high and the gas floating speed is slow, the degassing is insufficient as mentioned above, but according to the overheat melting treatment, the composite slurry is heated to a temperature higher than a liquidus line temperature of metal as a dispersing medium, so that the viscosity of the composite slurry is lowered to facilitate the floating of the gas and promote the degassing, and further the solid phase of the metal as a dispersing medium is lost to more uniformly disperse the dispersion strengthening material in the dispersing medium.

In the invention, the stirring is continued through the step of adding the dispersion strengthening material to the mixed solid-liquid phase slurry and the step of subjecting the composite slurry to the overheat melting treatment, so that there is caused a tendency that the dispersing medium is apt to be oxidized and the wetting of the dispersion strengthening materials to the oxidized dispersing medium may be deteriorated. Therefore, it is preferable to conduct these steps in an inert gas atmosphere such as Ar gas or the like.

Further, the above steps are carried out under a reduced pressure in order to promote the wetting of the dispersion strengthening material to the dispersing medium and the generation of reaction gas between the dispersing medium and the surface deposit in the dispersion strengthening material for prematurely completing the generation of the reaction gas and improving the degassing effect. In this case, the reduced pressure is preferably within a range of 100 Torr to $1\times10^{-4}$ Torr. When the reduced pressure exceeds 100 Torr, the wetting of the dispersion strengthening material to the dispersing medium, the promotion of the reaction gas generation and the degassing effect are insufficient, while when it is less than $1\times10^{4}$ Torr, the dispersing medium may easily be evaporated, and also the installation cost becomes higher and the operation time becomes longer.

When the dispersion strengthening material is comprised of ultra-fine particles, if the reduced pressure exceeds 1 Torr, the wetting of the dispersion strengthening material to the dispersing medium, the promotion of the reaction gas generation and the degassing effect are insufficient. Therefore, in the case of using the ultra-fine dispersion strengthening material, the reduced pressure is favorably within a range of 1 Torr to $1\times10^{-4}$ Torr.

When the dispersion strengthened metal matrix composite is produced through the semi-solidification process, if the temperature width between solidus line and liquidus line in the alloy as a dispersing medium of the composite material is narrow and the ratio of eutectic texture is large, it is difficult to hold a good mixed solid-liquid phase state at the production step including the addition of the dispersion strengthening material and, hence, the production of the metal matrix composite becomes difficult. According to the second aspect of the invention, therefore, the mixed solid-liquid phase slurry of semi-solidified or semi-molten state having such a composition that a temperature width between solidus line and liquidus line is wider than that of an alloy composition in a final product and a ratio of eutectic texture is small is first prepared before the incorporation of the dispersion strengthening material, so that the good mixed solid-liquid phase state can more stably be held. Next, the dispersion strengthening material is incorporated into the slurry of good mixed solid-liquid phase state with stirring, so that the dispersion state of the dispersion strengthening material in the dispersing medium is uniform and good. Thereafter, the resulting precomposite material is synthesized with an ingredient separately prepared for the compensation of the final alloy composition, so that the dispersion strengthening material is uniformly dispersed in the dispersing medium having an objective alloy composition to obtain a final composite material.

In this method according to the invention, there is no problem on the kind of the alloy used as a dispersing medium of the composite material. Although Al alloy base composite materials such as JIS 6061 Al alloy, Si—Al alloys near to eutectic Si ingredient and the like have recently been put into practical use, these Al alloys are narrow in the temperature width between solidus line and liquidus line and are difficult to form a mixed solid-liquid phase state. Particularly, this method is effective to these Al alloys. Furthermore, when the temperature width between solids line and liquids line in the alloy as a dispersing medium of the composite material is not higher than 15° C., it is difficult to produce the composite material by the conventional semi-solidification process, but the above method according to the invention facilitates the production of the composite material and has considerable effects thereon. Of course, this method is easy to hold a better mixed solid-liquid phase state even when the temperature width exceeds 15° C. and develops an effect of improving the quality and operability.

On the other hand, as the ratio of eutectic texture in the alloy as a dispersing medium becomes large, the fraction solid of primary crystal becomes small, so that it is difficult to form a good mixed solid-liquid phase state having a large fraction solid of primary crystal and, hence, the addition of the dispersion strengthening material can not be conducted under the stable mixed solid-liquid phase state. According to the invention, the objective composition A of the alloy as a dispersing medium of the final composite material is divided into a composition B as an alloy composition in which the temperature width between solidus line and liquidus line is wider than that of the alloy composition A and an ingredient C required for the compensation of the objective alloy composition A. Since the slurry of the composition B is prepared at a semi-solidified or semi-molten state, the better mixed solid-liquid phase state can stably be held, so that the dispersion strengthening material is added to the slurry. Thereafter, the resulting composite slurry is synthesized with an alloy or a metal corresponding to the ingredient C for the compensation of the alloy composition A. Thus, there can be obtained a final composite material uniformly dispersing the dispersion strengthening material therein and having a good quality.

In this case, the temperature of the slurry to be added with the ingredient C is desirable to be not lower than a liquidus line temperature of the objective alloy composition A for attaining the rapid and uniform dispersion of the ingredient C. However, when the slurry temperature is too high, the interfacial reaction between the dispersion strengthening material and the dispersing medium is promoted and also the viscosity of the dispersing medium lowers to easily separate the dispersion strengthening material from the dispersing medium, and hence the dispersion state of the dispersion strengthening material is deteriorated and the unfavorable precipitates are produced. Therefore, the upper limit of the slurry temperature is preferably 150° C. higher than the liquidus line temperature of the objective alloy composition.

In the production of the composite material through the semi-solidification process, the surface of the dispersion strengthening material is wetted with the dispersing medium. However, if the dispersing medium is oxidized or the amount of gas is large around the dispersion strengthening material at the addition thereof, the wettability is considerably degraded. Therefore, it is important to conduct the addition of the dispersion strengthening material in an inert gas atmosphere for the prevention of the oxidation. In this case, the gas pressure is preferably within a range of 100 Torr to $1\times10^{4}$ Torr. When the gas pressure exceeds 100 Torr, the amount of the inert gas at the boundary between the dispersion strengthening material and the dispersing medium in the addition of the dispersion strengthening material becomes large and hence the wettability is degraded, while when it is less than $1\times10^{-4}$ Torr, the alloying ingredient in the dispersing medium is apt to be evaporated, and also the installation cost becomes high and the operation time becomes unfavorably longer.

Furthermore, the incorporation of the dispersion strengthening material into the semi-solidified or semi-molten slurry is preferably carried out with stirring. In case of mechanical stirring using a rotating stirrer, the revolution number is favorable to be within a range of 100 rpm to 1000 rpm.

In order to maintain a good mixed solid-liquid phase state, it is important to continue the stirring over steps including the addition of the dispersion strengthening material. Preferably, the stirring is continued till the ingredient C is added while holding the temperature above the liquidus line temperature of the objective alloy composition A as the dispersing medium in order to achieve the uniform dispersion of the dispersion strengthening material and the uniform and sure dispersion of the ingredient C.

When the final product is a pure metal or an extreme-low alloy based on this metal, the precomposite material of the dispersing medium is preferable to have a temperature width between solidus line and liquidus line of not lower than 30° C. Moreover, when the precomposite material is incorporated into the ingredient C for the compensation of the objective alloy composition, it may be added in the form of a slurry or a lump. In the case of adding the lump, it is preferable to use a cut piece of the lump for easily dissolving into the dispersing medium.

When the objective alloy composition of the dispersing medium is a low alloy requiring a high conductivity such as copper alloy, in order to facilitate the formation of the mixed solid-liquid phase slurry, the composition B is a pure metal or an extreme-low alloy near to the pure metal. However, this is not necessarily applied to high alloys and eutectic alloy composition as a dispersing medium.

As the dispersion strengthening material used in the invention, mention may be made of particles and whiskers of ceramics and metals and metal short fibers such as particle or whisker of silicon carbide, particle or whisker of alumina, whisker of potassium titanate, particle of titanium carbide, particle or whisker of silicon oxide, boron short fiber and the like.

The following examples are given in illustration of the invention and are not intended as limitations thereof.

At first, an apparatus for the production of the composite material used in the following examples will be described with reference to FIG. 1.

In FIG. 1, numeral 1 is a crucible, numeral 2 a rotating stirrer, numeral 3 a device for the addition of a dispersion strengthening material, numeral 4 a device for the addition of an ingredient for the compensation of final alloy composition, numeral 5 a mold. These members are placed in a closed space of a vacuum tank 6. The vacuum tank 6 is provided with a discharge port 7 and an inlet port 8 for atmosphere gas, whereby the inside of the vacuum tank 6 may be adjusted to optional reduced pressure and optional gas atmosphere.

EXAMPLE 1

A composite material is produced by using the apparatus shown in FIG. 1, in which 270 g in total of SiC particles having a particle size of 8 μm as a dispersion strengthening material is added at a rate of 5 g/min to 2400 g of a mixed solid-liquid phase slurry of 7 wt % Si-0.3 wt % Mg—Al alloy (solids line temperature: 559° C., liquids line temperature: 615° C.) in the crucible 1 from the device 3 at a temperature of 603° C. and a fraction solid of 0.20 in an Ar gas atmosphere under a reduced pressure of $1\times10^{-2}$ Torr with stirring over 54 minutes to form a composite slurry. Thereafter, the composite slurry is stirred with the rotating stirrer 2 at a temperature of 603° C. (fraction solid of dispersing medium: 0.2) in the same atmosphere under the same reduced pressure for 30 minutes and heated to 700° C., which is poured into the mold 5 to form a composite material (cast ingot).

The composition, metallurgical texture, gas content and density are measured with respect to the thus obtained composite material.

Comparative Example 1

The same procedure as in Example 1 is repeated except that the temperature of the composite slurry is raised to 700° C. immediately after the completion of the addition of the dispersion strengthening material. The same measurement as in Example 1 is conducted with respect to the resulting composite material.

As a result, in the composite materials of Example 1 and Comparative Example 1, it is confirmed that the composition of the alloy as a dispersing medium is 7 wt % Si-0.3 wt % Mg—Al alloy and 10 wt % of SiC particles having a particle size of 8 μm are dispersed therein.

Figure 2:
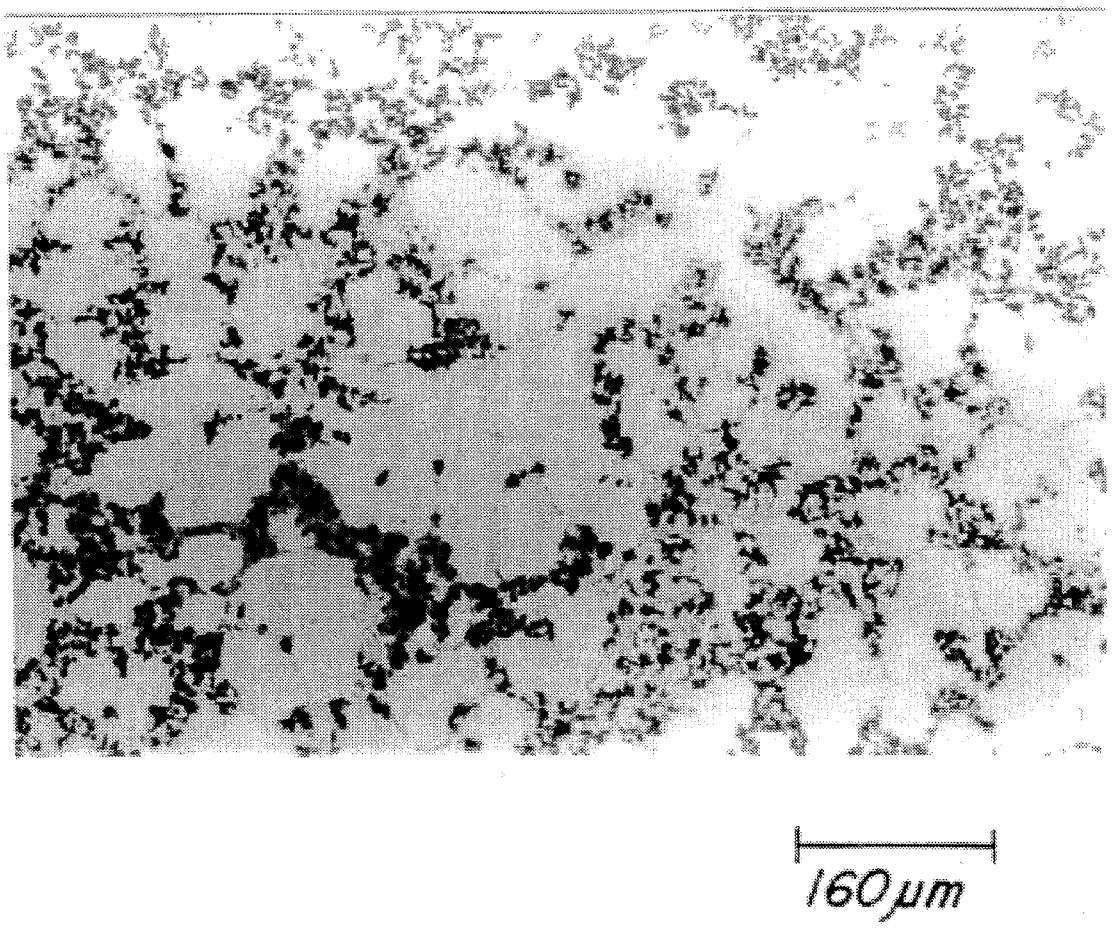
FIG. 2 is a metallographical microphotograph of a composite material produced in Example 1.
Figure 3A:
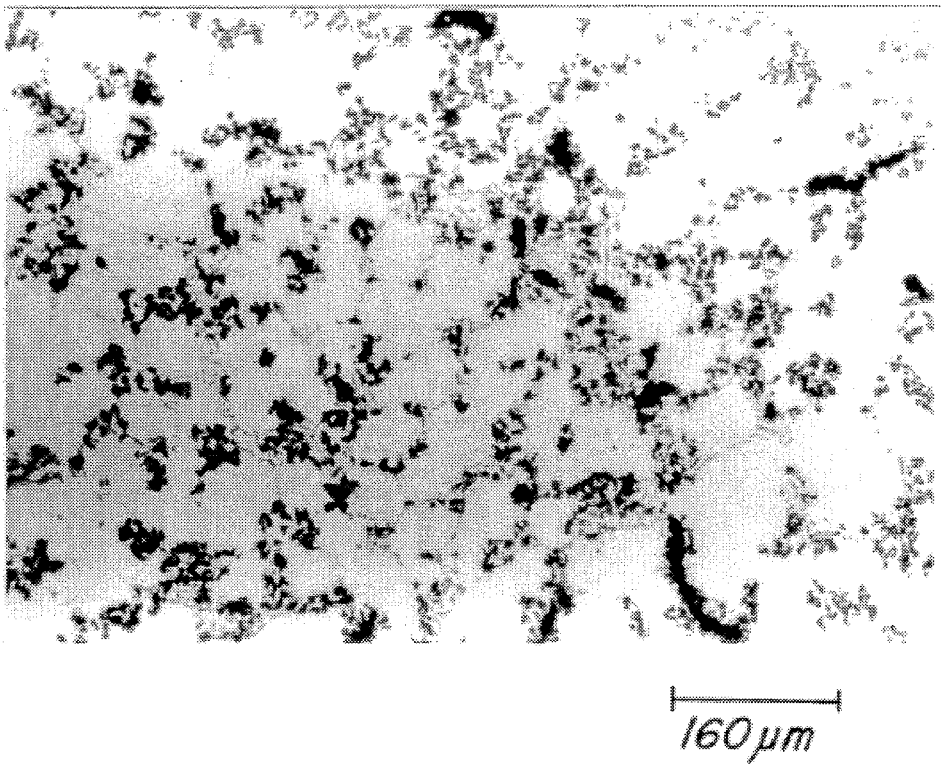
FIGS. 3*a* and 3*b* are a metallographical microphotograph and its schematic representation of a composite material produced in Comparative Example 1, respectively.
Figure 3B:
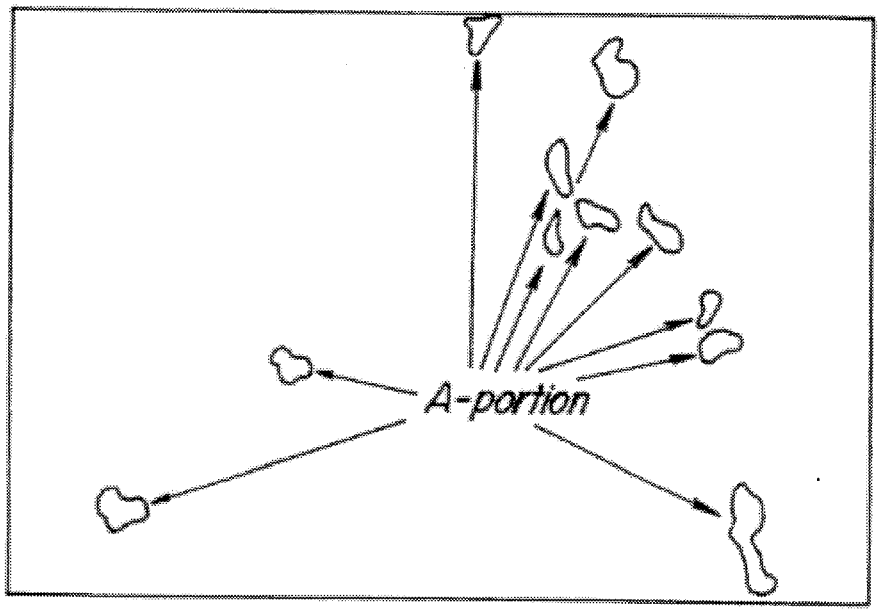

Next, the metallurgical texture of the composite material in Example 1 is shown in FIG. 2 as a microphotograph, while the metallurgical texture of the composite material in Comparative Example 1 is shown in FIG. 3*a* as a microphotograph and its illustration is shown in FIG. 3*b* in which an A-portion is a densely aggregated portion of SiC particles.

As seen from FIG. 2, the composite material of Example 1 is very good in the uniformly dispersed state of the dispersion strengthening material, while the composite material of Comparative Example 1 has the densely aggregated portions of the dispersion strengthening material as shown in FIGS. 3*a* and 3*b*. That is, the formation of the densely aggregated portion can not be avoided in Comparative Example 1.

In the composite material of Example 1, the gas content is 0.24 cc/100 g and the density is 2.70 g/cm$^3$, while the composite material of Comparative Example 1 has a gas content of 0.29 cc/100 g and a density of 2.67 g/cm$^3$.

These results show that the quality of the composite material in Example 1 is superior to that in Comparative Example 1.

Example 2

A composite material is produced by using the apparatus shown in FIG. 1, in which 270 g in total of SiC particles having a particle size of 1 μm as a dispersion strengthening material is added at a rate of 1.5 g/min to 2400 g of a mixed solid-liquid phase slurry of 7 wt % Si-0.3 wt % Mg—Al alloy (solidus line temperature: 559° C., liquidus line temperature: 615° C.) in the crucible 1 from the device 3 at a temperature of 589° C. and a fraction solid of 0.35 in an Ar gas atmosphere under a reduced pressure of $1\times10^{-2}$ Torr with stirring over 180 minutes to form a composite slurry. Thereafter, the composite slurry is stirred with the rotating stirrer 2 at a temperature of 603° C. (fraction solid of dispersing medium: 0.2) in the same atmosphere under the same reduced pressure for 30 minutes and heated to 700° C. higher than liquids line temperature of the dispersing medium with the stirring in the same atmosphere under the same reduced pressure and then the stirring is continued for 30 minutes, which is poured into the mold 5 to form a composite material (cast ingot).

The composition, metallurgical texture, gas content and density are measured with respect to the thus obtained composite material.

Comparative Example 2

The same procedure as in Example 2 is repeated except that the temperature of the composite slurry is raised to 700° C. immediately after the completion of the addition of the dispersion strengthening material and then held at this temperature for 30 minutes. The same measurement as in Example 2 is conducted with respect to the resulting composite material.

As a result, in the composite materials of Example 2 and Comparative Example 2, it is confirmed that the composition of the alloy as a dispersing medium is 7 wt % Si-0.3 wt. % Mg—Al alloy and 10 wt % of SiC particles having a particle size of 1 μm are dispersed therein.

Figure 4:
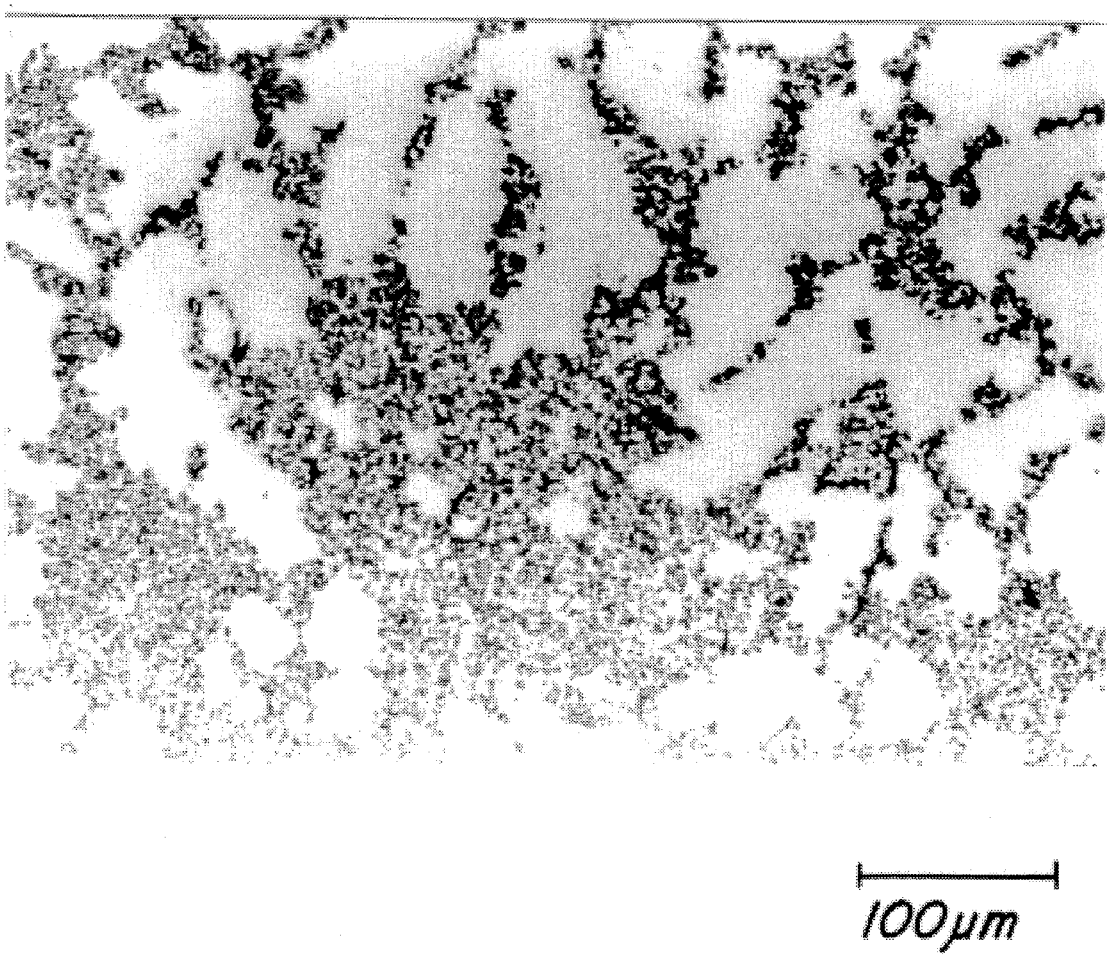
FIG. 4 is a metallographical microphotograph of a composite material produced in Example 2.
Figure 5A:
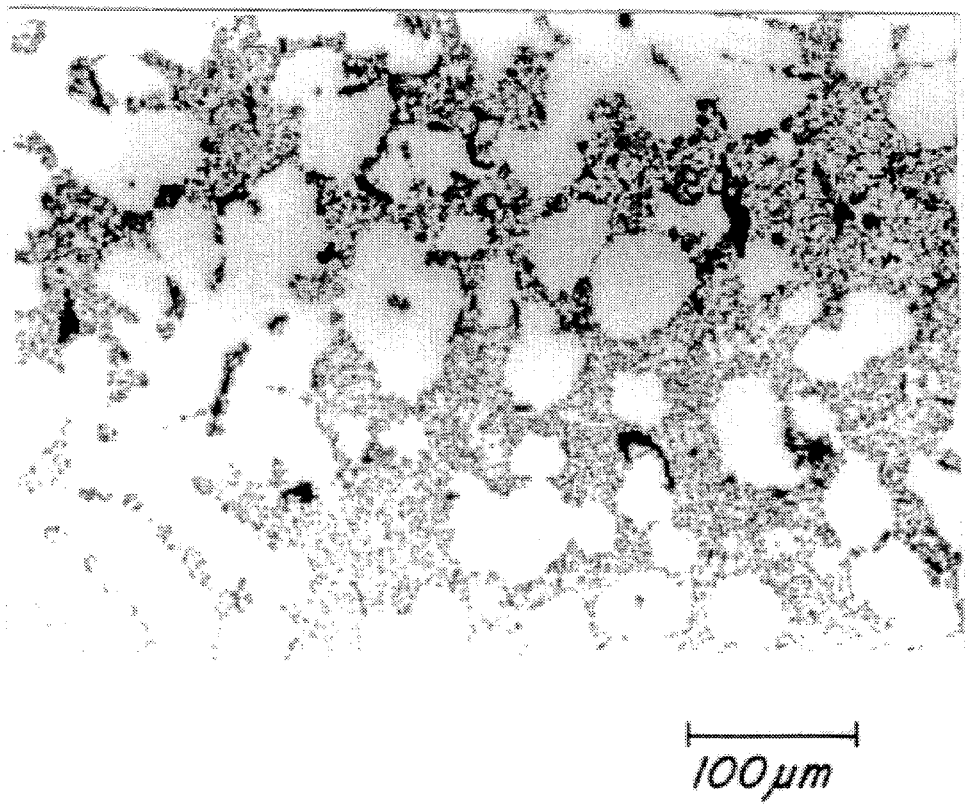
FIGS. 5*a* and 5*b* are a metallographical microphotograph and its schematic representation of a composite material produced in Comparative Example 2, respectively.
Figure 5B:
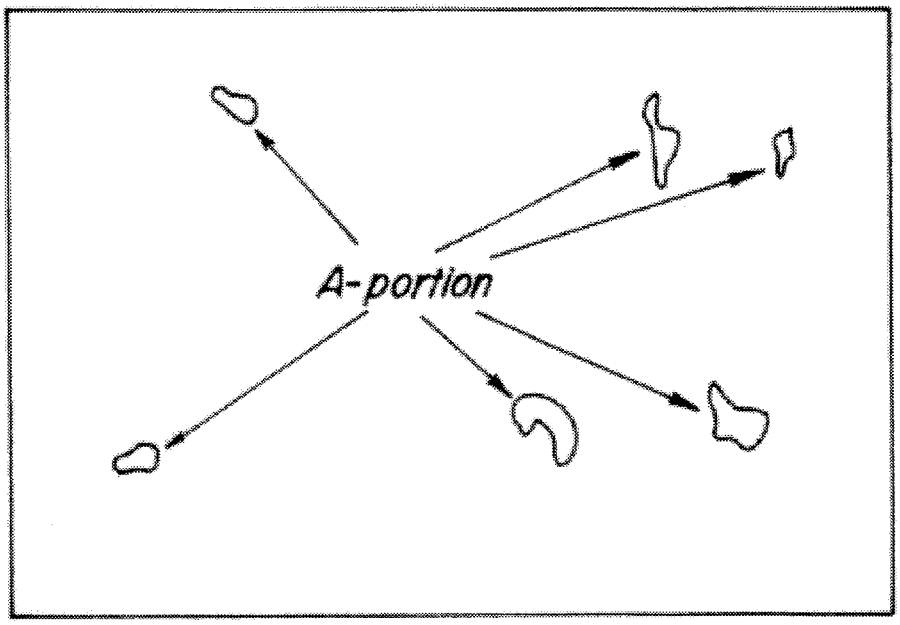

Next, the metallurgical texture of the composite material in Example 2 is shown in FIG. 4 as a microphotograph, while the metallurgical texture of the composite material in Comparative Example 2 is shown in FIG. 5*a* as a microphotograph and its illustration is shown in FIG. 5*b* in which an A-portion is a densely aggregated portion of SiC particles.

As seen from FIG. 4, the composite material of Example 2 is very good in the uniformly dispersed state of the dispersion strengthening material, while the composite material of Comparative Example 2 has the densely aggregated portions of the dispersion strengthening material as shown in FIGS. 5*a* and 5*b*. That is, the formation of the densely aggregated portion can not be avoided in Comparative Example 2.

In the composite material of Example 2, the gas content is 0.30 cc/100 g and the density is 2.68 g/cm$^3$, while the composite material of Comparative Example 2 has a gas content of 0.40 cc/100 g and a density of 2.65 g/cm$^3$.

These results show that the quality of the composite material in Example 2 is superior to that in Comparative Example 2.

Even when the ultra-fine SiC particles having a particle size of 1 μm are used as a dispersion strengthening material, the invention can provide a composite material having a good quality.

EXAMPLE 3

A composite material is produced by using the apparatus shown in FIG. 1, in which SiC particles having a particle size of 5 μm as a dispersion strengthening material is added at a rate of 1.5 g/min to 2400 g of a mixed solid-liquid phase slurry of 7 wt % Si- 0.3 wt % Mg—Al alloy (solidus line temperature: 559° C., liquidus line temperature: 615° C.) in the crucible 1 from the device 3 at a temperature of 589° C. and a fraction solid of 0.35 in an Ar gas atmosphere under a reduced pressure of 100 Tort with stirring over 180 minutes to form a composite slurry. Thereafter, the composite slurry is stirred with the rotating stirrer 2 at a temperature of 603° C. (fraction solid of dispersing medium: 0.2) in the same atmosphere under the same reduced pressure for 30 minutes and heated to 700° C. higher than liquidus line temperature of the dispersing medium with the stirring in the same atmosphere under the same reduced pressure and then the stirring is continued for 30 minutes, which is poured into the mold 5 to form a composite material (cast ingot).

The composition, metallurgical texture, gas content and density are measured with respect to the thus obtained composite material.

EXAMPLE 4

The same procedure as in Example 3 is repeated except that the Ar gas atmosphere is used under a reduced pressure of $1\times10^{-4}$ Torr. The same measurement as in Example 3 is conducted with respect to the resulting composite material.

Comparative Example 3

The same procedure as in Example 3 is repeated except that the Ar gas atmosphere is used under a reduced pressure of 700 Torr. The same measurement as in Example 3 is conducted with respect to the resulting composite material.

Comparative Example 4

The same procedure as in Example 3 is repeated except that the reduced pressure is $1\times10^{-5}$ Torr, during which gas is generated by the evaporation of the dispersing medium, so that the reduced pressure can not be maintained at a level of $1\times10^{5}$ Torr.

As a result, in the composite materials of Examples 3 and 4 and Comparative Example 3, it is confirmed that the composition of the alloy as a dispersing medium is 7 wt % Si-0.3 wt. % Mg—Al alloy and 10 wt % of SiC particles having a particle size of 5 μm are dispersed therein.

In the composite materials of Examples 3 and 4, the gas content is 0.25 cc/100 g and 0.22 cc/100 g, respectively, and the density is 2.70 g/cm$^3$ and 2.71 g/cm$^3$, respectively, while the composite material of Comparative Example 3 has a gas content of 0.48 cc/100 g and a density of 2.54 g/cm$^3$.

These results show that the quality of the composite material in Examples 3 and 4 is superior to that in Comparative Example 3.

EXAMPLE 5

A composite material is produced by using the apparatus shown in FIG. 1, in which 600 g in total of SiC particles having a particle size of 10 μm as a dispersion strengthening material is added at a rate of 2.5 g/min to 2400 g of a mixed solid-liquid phase slurry of 7 wt % Si-0.3 wt. % Mg—Al alloy (solidus line temperature: 559° C., liquidus line temperature: 615° C.) in the crucible 1 from the device 3 at a temperature of 603° C. and a fraction solid of 0.2 in an Ar gas atmosphere under a reduced pressure of 100 Torr with stirring over 240 minutes to form a composite slurry. Thereafter, the composite slurry is heated to 700° C. with the stirring in the same atmosphere under the same reduced pressure and then the stirring is continued for 30 minutes, which is poured into the mold 5 to form a composite material (cast ingot). The composition, metallurgical texture, gas content and density are measured with respect to the thus obtained composite material.

EXAMPLE 6

The same procedure as in Example 5 is repeated except that the Ar gas atmosphere is used under a reduced pressure of $1\times10^{-4}$ Torr and the dispersion strengthening material is added at a rate of 10 g/min over 60 minutes. The same measurement as in Example 5 is conducted with respect to the resulting composite material.

Comparative Example 5

The same procedure as in Example 5 is repeated except that the Ar gas atmosphere is used under a reduced pressure of 700 Torr and 600 g in total of the dispersion strengthening material is added at a rate of 1 g/min, which is slower than a practical addition rate, over 600 minutes. The same measurement as in Example 5 is conducted with respect to the resulting composite material.

Comparative Example 6

The same procedure as in Example 5 is repeated except that the reduced pressure is $1\times10^{-5}$ Torr, during which gas is generated by the evaporation of the dispersing medium, so that the reduced pressure can not be maintained at a level of $1\times10^{-5}$ Torr.

As a result, in the composite materials of Examples 5 and 6 and Comparative Example 5 , it is confirmed that the composition of the alloy as a dispersing medium is 7 wt % Si-0.3 wt % Mg—Al alloy and 20 wt % of SiC particles having a particle size of 10 μm are dispersed therein.

Figure 6:
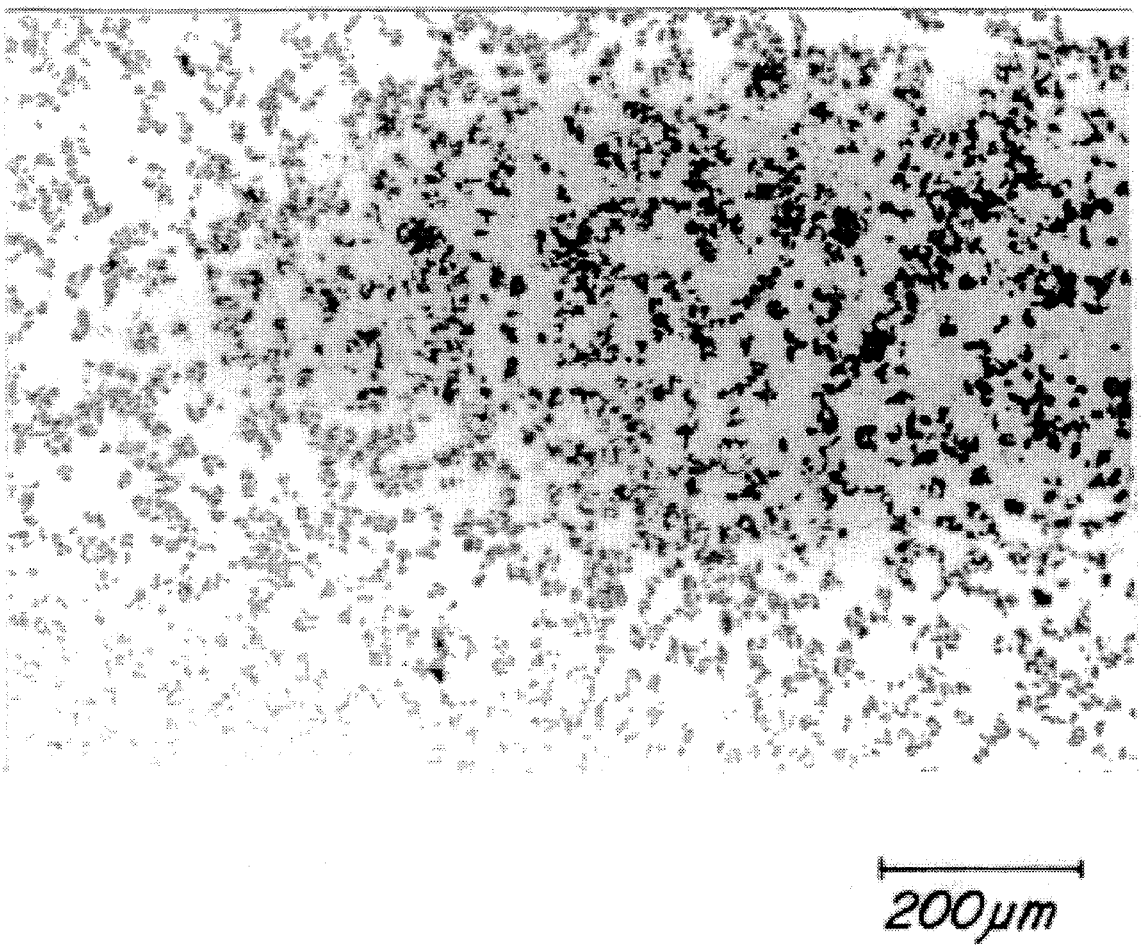
FIG. 6 is a metallographical microphotograph of a composite material produced in Example 5.
Figure 7A:
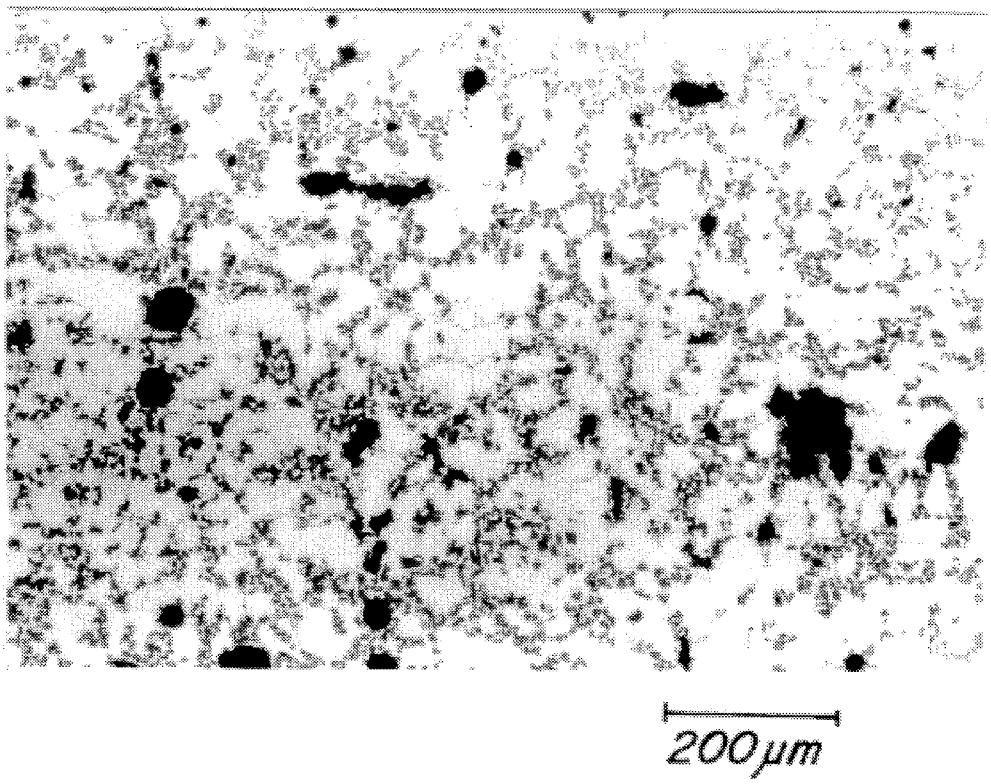
FIGS. 7*a* and 7*b* are a metallographical microphotograph and its schematic representation of a composite material produced in Comparative Example 5, respectively.
Figure 7B:
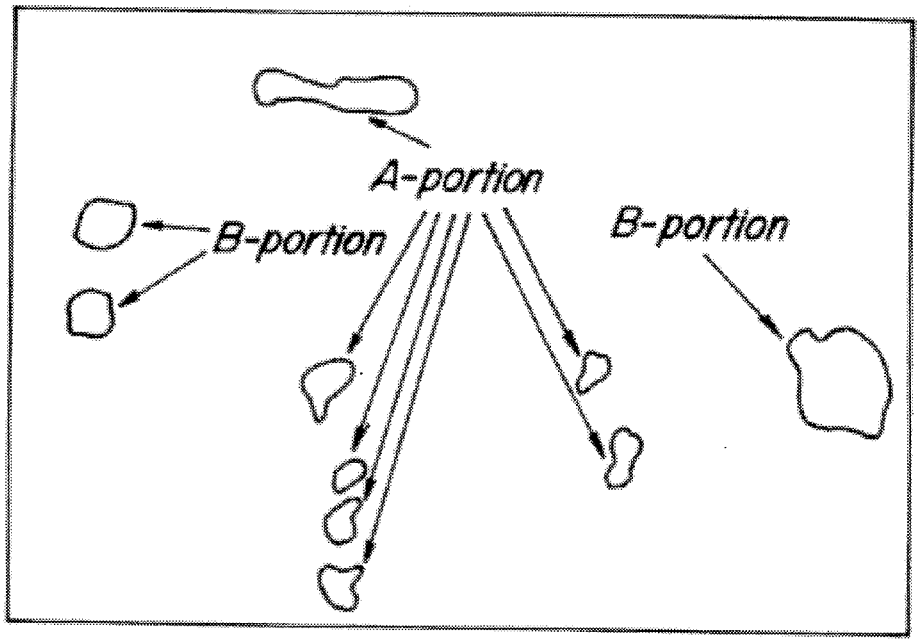

Next, the metallurgical texture of the composite material in Example 5 is shown in FIG. 6 as a microphotograph, while the metallurgical texture of the composite material in Comparative Example 5 is shown in FIG. *7a* as a microphotograph and its illustration is shown in FIG. *7b* in which an A-portion is a densely aggregated portion of SiC particles and a B-portion is a bubble portion. Moreover, the metallurgical texture of the composite material in Example 6 is the same as in Example 5.

Further, the gas content and density are measured to obtain results as shown in Table 1.

TABLE 1

| | Gas content (cc/100 g) | Density (g/cm$^3$) |
|---|---|---|
| Example 5 | 0.24 | 2.69 |
| Example 6 | 0.21 | 2.73 |
| Comparative Example 5 | 0.65 | 2.42 |

As seen from the above results, the composite material of Comparative Example 5 has the densely aggregated portions of SiC particles and the bubble portions as shown in FIGS. *7a* and *7b*. That is, the formation of these defect portions can not be avoided in Comparative Example 5. On the other hand, the composite materials of Examples 5 and 6 have no densely aggregated portions of SiC particles and no bubble portions as shown in FIG. 6 and are uniform and very good in the dispersed state of the dispersion strengthening material.

Moreover, as seen from Table 1, the composite materials of Examples 5 and 6 are less in the gas content and large in the density as compared with those of Comparative Example 5, which show that the composite material according to the invention has a good quality without defect. EXAMPLE 7

A composite material consisting of 11.7 wt % Si— 0.3 wt % Mg—Al alloy (liquids line temperature: 575° C. solids line temperature: 573° C.) as a dispersing medium and SiC particles as a dispersion strengthening material is produced by using the apparatus shown in FIG. 1. In this case, 2279 g of 7.0 wt % Si—0.32 wt % Mg—Al alloy (liquidus line temperature: 615° C., solidus line temperature: 559° C.) having a temperature width between solidus line and liquidus line wider than that of the dispersing medium is prepared in the crucible 1 and stirred with the rotating stirrer 2 (revolution number: 450 rpm) at a temperature of 603° C. as a mixed solid-liquid phase state having a fraction solid of 0.20 and then 600 g in total of SiC particles having a particle size of 10 μm as a dispersion strengthening material is added thereto at a rate of 10 g/min from the device 3 over 60 minutes to form a precomposite material. Thereafter, the precomposite material is heated to 700° C. with the stirring and then the stirring is continued for 30 minutes. Thereafter, 121 g of Si lump as an ingredient required for the compensation of dispersing medium composition is added from the device 4 and then stirred for 30 minutes, which is poured into the mold 5 to form a cast ingot.

Moreover, the stirring is carried out in an Ar gas atmosphere under a reduced pressure of $10^{-2}$ Torr.

The composition and metallurgical texture are measured with respect to the thus obtained cast ingot.

Comparative Example 7

A composite material is produced by directly incorporating a dispersion strengthening material into a melt of 11.7 wt % Si-0.3 wt. % Mg—Al alloy as a dispersing medium.

In this case, the growth of shell is remarkable near to the liquidus line temperature of the Al alloy or at a temperature of lower than 575° C., so that a good mixed solid-liquid phase state can not be obtained.

Therefore, the Al alloy melt is stirred at 600° C. in the crucible 1 in the same manner as in Example 7, to which is added SiC particles having a particle size of 10 μm and heated to 700° C. with stirring and then the stirring is continued for 60 minutes. Moreover, the stirring is carried out in the same atmosphere as in Example 7.

The composition and metallurgical texture are measured with respect to the cast ingot in the same manner as in Example 7.

Figure 8:
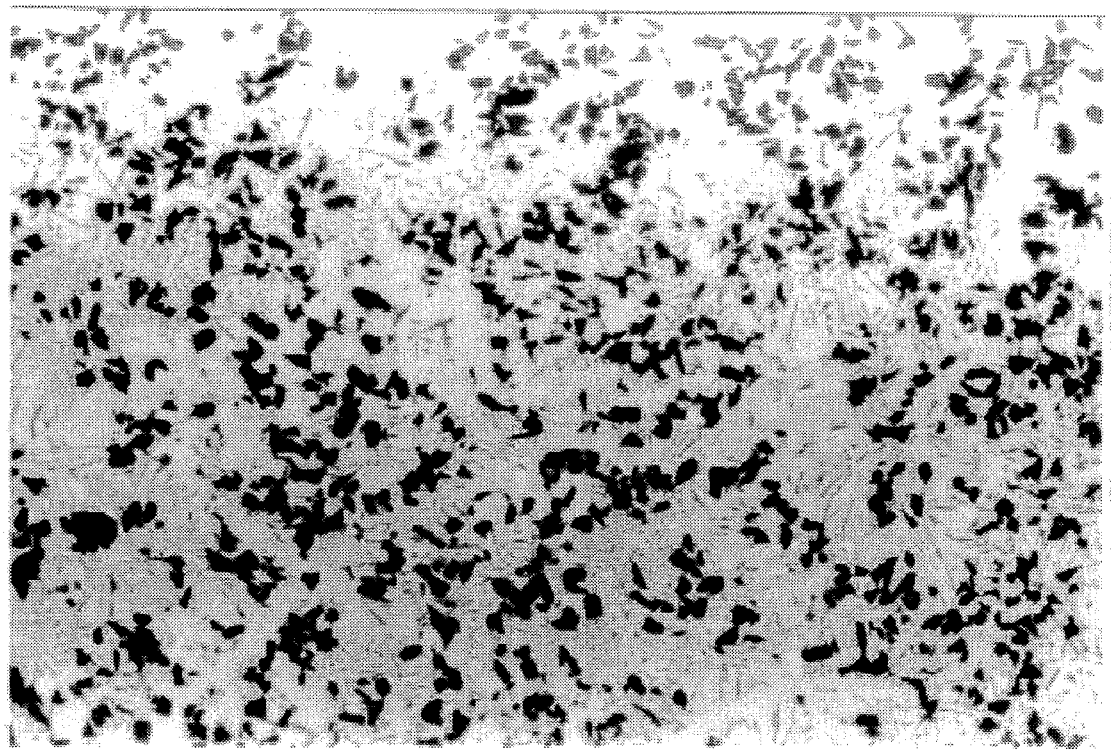
FIG. 8 is a metallographical microphotograph of a composite material produced in Example 7.
Figure 9A:
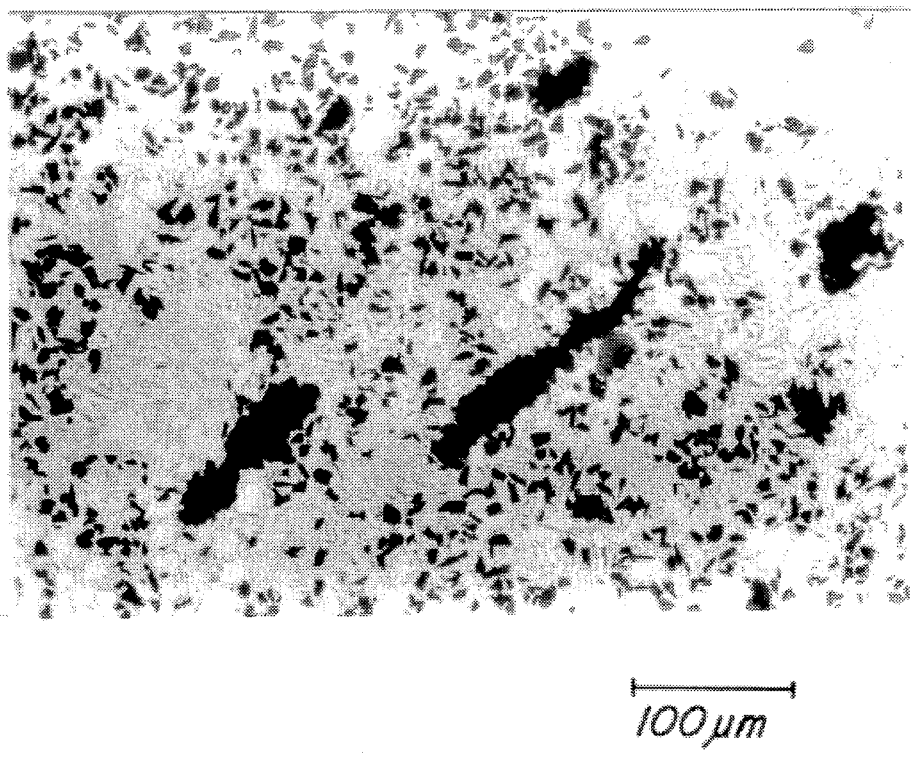
FIGS. 9*a* and 9*b* are a metallographical microphotograph and its schematic representation of a composite material produced in Comparative Example 7, respectively.

The metallurgical textures of the cast ingots in Example 7 and Comparative Example 7 are shown in FIGS. 8 and 9*a* as a microphotograph, respectively. Moreover, FIG. 9*b* is an illustration of FIG. 9*a* in which an A-portion is a densely aggregated portion of SiC particles.

In these cast ingots, it is confirmed that the alloy composition of the dispersing medium is 11.7 wt % Si-0.3 wt % Mg—Al alloy and 20 wt % of SiC particles having a particle size of 10 μm are dispersed in the dispersing medium.

Figure 9B:
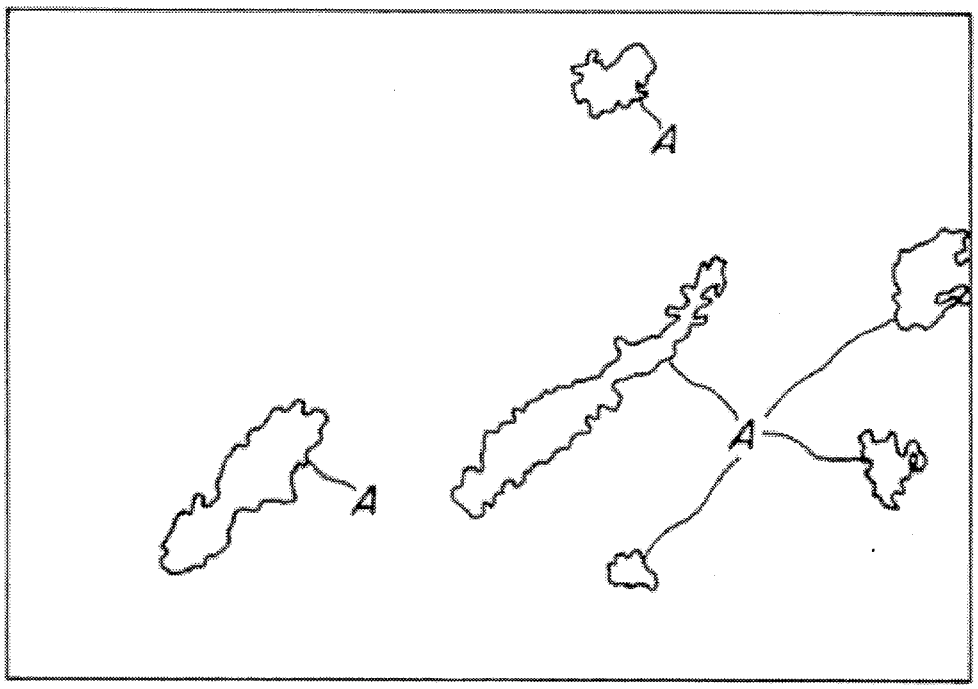

In Comparative Example 7, however, the formation of the densely aggregated portion of SiC particles can not be avoided as shown in FIGS. 9*a* and 9*b*, while the composite material of Example 7 shows that the densely aggregated portion of SiC particles is not formed as shown in FIG. 8 and the dispersion state of SiC particles is very uniform.

EXAMPLES 8–9

Comparative Example 8

Various composite materials are produced by changing the temperature of the dispersing medium when the ingredient required for the compensation of the objective alloy composition is added after the incorporation of the dispersion strengthening material at a solid-liquid phase coexisting state.

The same procedure as in Example 7 is repeated except that the temperature of the dispersing medium in the addition of the ingredient is set to 725° C. (corresponding to liquidus line temperature (° C.) of objective alloy composition +150° C.: Example 8) or 815° C. (corresponding to liquidus line temperature (° C.) of objective alloy composition +240° C.: Comparative Example 8).

In Example 9, 2341 g of 9.5 wt % Si-0.31 wt % Mg— Al alloy (liquidus line temperature: 596° C., solids line temperature: 557° C.) having a temperature width between solidus line and liquids line wider than that of the same dispersing medium as in Example 7 (11.7 wt % Si-0.3 wt % Mg—Al alloy) is prepared in the crucible 1 and stirred with the rotating stirrer 2 (revolution number: 500 rpm) at a temperature of 587° C. as a mixed solid-liquid phase state having a fraction solid of 0.20 and then 600 g in total of SiC particles having a particle size of 10 μm as a dispersion strengthening material is added thereto at a rate of 10 g/min from the device 3 over 60 minutes to form a precomposite material. Thereafter, the precomposite material is stirred for uniformly dispersing SiC particles even in the solid phase and heated to 650° C. with the stirring for removing the solid phase other than SiC particles and then the stirring is continued for 30 minutes. Thereafter, 59 g of Si lump as an ingredient required for the compensation of dispersing medium composition is added from the device 4 and then stirred for 60 minutes while maintaining the temperature of the dispersing medium above 575° C. and heated to 630° C. for improving the fluidization of the dispersing medium melt, which is immediately poured into the mold 5 to form a cast ingot. Moreover, the stirring is carried out in an Ar gas atmosphere under a reduced pressure of $10^{-2}$ Torr.

Moreover, it is attempted to drop the temperature of the medium to lower than 575° C. after the addition of Si lump, but the formation of shell is conspicuous and Si lump can not be incorporated into the melt of the precomposite material.

The composition and metallurgical texture are measured with respect to the resulting cast ingots.

In Comparative Example 8, precipitates of $Al_4C_3$ are observed and the dispersion state of SiC particles are ununiform. On the other hand, in Examples 8 and 9, the precipitates are not observed likewise Example 7 (FIG. 8) and the dispersion state of SiC particles is very uniform.

In the cast ingots of Examples 8 and 9 and Comparative Example 8, it is confirmed that the alloy composition of the dispersing medium is 11.7 wt % Si-0.3 wt % Mg—Al alloy and 20 wt % of SiC particles having a particle size of 10 μm are dispersed in the dispersing medium.

EXAMPLES 10–11

Comparative Examples 9–10

The same procedure as in Example 7 is repeated by changing a gas pressure in the vacuum tank 6 under Ar gas atmosphere.

The gas pressure and conditions for the addition of SiC particle are shown in Table 2.

TABLE 2

| | Gas pressure | Conditions for the addition of SiC particles | |
|---|---|---|---|
| | in vacuum tank (Torr) | Addition rate (g/min) | Addition time (minutes) |
| Example 10 | 100 | 2.5 | 240 |
| Example 11 | $1 \times 10^{-4}$ | 10 | 60 |
| Comparative Example 9 | 700 | 1 | 600 |
| * Comparative Example 10 | $1 \times 10^{-5}$ | 10 | 60 |

Note) *: In Comparative Example 10, the gasification of the alloying ingredients is caused, so that the inside of the vacuum tank can not be maintained at $10^{-5}$ Torr and hence the production is stopped.

The composition and metallurgical texture are measured with respect to the resulting cast ingots.

In the cast ingots of Examples 10 and 11 and Comparative Example 9, it is confirmed that the alloy composition of the dispersing medium is 11.7 wt % Si-0.3 wt % Mg—Al alloy and 20 wt % of SiC particles having a particle size of 10 μm are dispersed in the dispersing medium.

In Comparative Example 9, however, the formation of the densely aggregated portion of SiC particles can not be avoided likewise Comparative Example 7 (FIG. 9). In Examples 10 and 11, the densely aggregated portion of SiC particles is not observed likewise Example 7 (FIG. 8) and the dispersion state of SiC particles is very uniform.

EXAMPLE 12

A composite material consisting of Cu-0.19 mass % Sn alloy (temperature width between solids line and liquids line: 6° C.) as a dispersing medium and 1 wt % of $Al_2O_3$ as a dispersion strengthening material is produced by using the apparatus shown in FIG. 1 as follows.

A mixed solid-liquid phase slurry having a fraction solid of 0.3 is prepared in the crucible 1 by using 2500 g of Cu-1 mass % Sn alloy (temperature width between solidus line and liquidus line: 33° C.) having a temperature width between solidus line and liquidus line wider than that of the dispersing medium at a temperature of 1067° C., to which is added 132 g in total of $Al_2O_3$ particles having a particle size of 1 μm from the device 3 at a rate of 1.0 g/min over 132 minutes with stirring and heated to 1125° C. with stirring and poured into the mold 5 to form a cast ingot of a precomposite material (Cu-1 mass % Sn alloy: 95 wt %, $Al_2O_3$ particles: 5 wt %). Then, the cast ingot is cut into a size of 20×20×20 mm.

Then, 3000 g of pure copper is melted in the crucible 1 at a temperature of 1133° C. (liquidus line temperature +50° C.) and held for 30 minutes with stirring and added with 750 g of the above cut precomposite material from the device 4, whereby the medium is melted and alloyed with pure copper and the dispersion strengthening material is uniformly dispersed therein to prepare a composite slurry having an objective alloy composition of the dispersing medium, which is poured into the mold 5 to form a cast ingot of a composite material (Cu-0.19 mass % Sn alloy: 99 wt %, $Al_2O_3$ particles: 1 wt %).

The dispersion state of the dispersion strengthening material, conductivity and hardness are measured with respect to the resulting composite material. As a result, there is obtained a high-strength and high-conductivity composite material in which the dispersion state is uniform and the conductivity is 75% and the hardness is 70 (HRF).

Comparative Example 11

Although it is attempted to prepare 2400 g of Cu-0.19 mass % Sn alloy in the crucible 1 as a mixed solid-liquid phase slurry, when the temperature is dropped to about liquidus line temperature (1082° C.) in the stirring bath, the formation of shell becomes conspicuous and hence it is impossible to drop the temperature below the liquidus line temperature.

Therefore, while the stirring bath is stably held at a temperature of 1132° C., $Al_2O_3$ particles having a particle size of 1 μm is added, but almost of these particles float on the bath surface and are not incorporated into the inside of the bath.

As mentioned above, according to the invention, the dispersion strengthening material is incorporated into the semi-solidified or semi-molten medium having a temperature width between solidus line and liquidus line wider than that of the objective alloy composition of the dispersing medium in the final product, so that the better mixed solid-liquid phase state can stably be maintained and, hence, the dispersion state of the dispersion strengthening material becomes good. Furthermore, the ingredient required for the compensation of the objective alloy composition as a dispersing medium is supplied, so that there is obtained composite materials in which the dispersion strengthening material is uniformly dispersed in the dispersing medium of the objective alloy composition.

As a result, even when the temperature width between solidus line and liquidus line of the alloy composition in the dispersing medium of the composite material is narrow, it is possible to produce the composite material through the semi-solidification process, so that the kind of alloy adaptable as a dispersing medium is considerably widened and the quality of the composite material and the production yield can be improved.

When the overheat melting treatment for the degassing is carried out by raising the temperature to not lower than liquidus line temperature of metal as a dispersing medium with stirring under a reduced pressure, there are obtained composite materials uniformly dispersing the dispersion strengthening material therein and having good quality and fewer defects due to the gas entrapment. This treatment is made possible to easily produce composite materials having good quality even when using fine dispersion strengthening material, so that the kind and size of the dispersion strengthening material to be applied can considerably be widened and the effect of improving product quality and production yield is large.

Moreover, the objective alloy composition of the dispersing medium in the composite material to be produced is divided into a composition having a temperature width between solidus line and liquidus line wider than that of the medium and a small ratio of eutectic texture and a composition required for the compensation of the objective alloy composition. The former composition is prepared as a mixed solid-liquid phase slurry and added with the dispersion strengthening material to form a precomposite material, which is mixed with the latter composition to provide the objective alloy composition. Therefore, the kind of the alloy as a dispersing medium to be used can considerably be widened as compared with the conventional semi-solidification process, whereby composite materials having good quality can be produced cheaply.

What is claimed is:

1. A method of producing a dispersion strengthened metal matrix composite comprising stirring a mixed solid-liquid phase slurry as a dispersing medium under a reduced pressure, adding a dispersion strengthening material to the dispersing medium, continuing stirring under reduced pressure until the dispersion strengthening material is uniformly dispersed in the dispersing medium, and subjecting the resulting composite slurry to an overheat melting treatment in which the temperature is raised to a temperature higher than a liquidus line of a metal in the dispersing medium to conduct degassing with the stirring under a reduced pressure.

2. A method of producing a dispersion strengthened metal matrix composite comprising stirring a mixed solid-liquid phase slurry as a dispersing medium under a reduced pressure, adding a dispersion strengthening material to the dispersing medium, and subjecting the resulting composite slurry to an overheat melting treatment in which the temperature is raised to a temperature higher than a liquidus line of a metal in the dispersing medium to conduct degassing with the stirring under a reduced pressure, and continuing stirring under reduced pressure until the dispersion strengthening material is uniformly dispersed in the dispersing medium.

3. The method according to claim 1 or 2, wherein said overheat melting treatment is carried out by raising to 150° C. higher than the liquidus line of the metal in said dispersing medium.

4. The method according to claim 1 or 2, wherein said stirring is carried out in an inert gas atmosphere under a reduced pressure of 100 Torr to $1\times10^{-4}$ Torr.

5. The method according to claim 1 or 2, wherein said reduced pressure is within a range of 1 Torr to $1\times10^{-4}$ Torr when using a ultra-fine dispersion strengthening material.

6. A method of producing a dispersion strengthened metal matrix composite comprising forming a product alloy composition, said method comprises preparing a mixed solid-liquid phase slurry of semi-solidified or semi-molten dispersing medium having a ratio of eutectic texture not greater than 0.3 and having such a composition that a temperature range between solidus line and liquidus line is larger than that of said product alloy composition of said metal matrix composite, incorporating a dispersion strengthening material into said dispersing medium with stirring to form a precomposite material, adding a) a separate alloying ingredient to a resulting molten precomposite material, or b) the precomposite material to a separate alloying molten ingredient, with stirring, to form said product alloy composition of said metal matrix composite.

7. The method according to claim 6, wherein said metal matrix composite is Al alloy, said dispersing medium having a temperature at the time of adding said alloying ingredient within a range of from a liquidus line temperature of said product alloy composition to 150° C. higher than the liquidus line temperature, and the incorporation of said dispersion strengthening material into said dispersing medium with stirring is conducted in an inert gas atmosphere under a reduced pressure of 100 Torr to $1\times10^{-4}$ Torr.

8. The method according to claim 6, wherein said dispersing medium is a pure metal or an extremely-low alloy thereof.

* * * * *

UNITED STATES PATENT AND TRADEMARK OFFICE

CERTIFICATE OF CORRECTION

PATENT NO. : 5,513,688

DATED : May 7, 1996

INVENTOR(S) : Yusuke Morita, Kazuhiro Ozawa & Akihiko Nanba

It is certified that error appears in the above-indentified patent and that said Letters Patent is hereby corrected as shown below:

In Column 8, line 8, please change "$1x10^{4}$" to --$1x10^{-4}$--.

In Column 11, line 6, please change "Tort" to --Torr--; and line 39, please change "$1x10^{5}$" to --$1x10^{-5}$--.

Signed and Sealed this

Thirteenth Day of August, 1996

Bruce Lehman

*Attest:*

BRUCE LEHMAN

*Attesting Officer*

*Commissioner of Patents and Trademarks*